US010264336B2

(12) United States Patent
Yeh et al.

(10) Patent No.: US 10,264,336 B2
(45) Date of Patent: Apr. 16, 2019

(54) ELECTRONIC DEVICE AND CONDUCTIVE STRUCTURE

(71) Applicant: HTC Corporation, Taoyuan County (TW)

(72) Inventors: Tung-Hsin Yeh, Taoyuan County (TW); Cheng-Chieh Chuang, Taoyuan County (TW); Shih-Ming Lin, Taoyuan County (TW)

(73) Assignee: HTC Corporation, Taoyuan (TW)

( * ) Notice: Subject to any disclaimer, the term of this patent is extended or adjusted under 35 U.S.C. 154(b) by 516 days.

(21) Appl. No.: 14/097,265

(22) Filed: Dec. 5, 2013

(65) Prior Publication Data

US 2014/0286523 A1 Sep. 25, 2014

Related U.S. Application Data

(60) Provisional application No. 61/804,183, filed on Mar. 21, 2013.

(51) Int. Cl.
*H04R 1/02* (2006.01)

(52) U.S. Cl.
CPC ..... *H04R 1/023* (2013.01); *H04R 2499/11* (2013.01)

(58) Field of Classification Search
CPC combination set(s) only.
See application file for complete search history.

(56) References Cited

U.S. PATENT DOCUMENTS 4,430,598 A * 2/1984 Okada ..... H01J 31/15 313/483
5,359,166 A * 10/1994 Elsaesser ..... H01H 13/70 200/305

(Continued)

FOREIGN PATENT DOCUMENTS

CN 1401182 3/2003
CN 1835522 9/2006

(Continued)

OTHER PUBLICATIONS

"Office Action of Taiwan Counterpart Application" , dated Jul. 21, 2015, p. 1-p. 4.

(Continued)

*Primary Examiner* — Duc Nguyen
*Assistant Examiner* — Assad Mohammed
(74) *Attorney, Agent, or Firm* — JCIPRNET

(57) ABSTRACT

An electronic device including a conductive casing, a conductive sheet, a conductive elastic pad, a circuit board and a sound output unit is provided. The conductive casing has an inner surface and a plurality of through holes extended from the inner surface to the outside of the conductive casing to pass through the conductive casing. The conductive sheet is disposed on the inner surface and covers part of the through holes. The conductive elastic pad is disposed in the conductive casing and contacts the conductive sheet. The circuit board is disposed in the conductive casing and connected with the conductive elastic pad. The sound output unit is disposed in the conductive casing and electrically connected to the circuit board. The sound output unit is adapted to output a sound transmitted to the outside of the electronic device by another part of the through holes. A conductive structure is also provided.

18 Claims, 3 Drawing Sheets

(56) References Cited

U.S. PATENT DOCUMENTS 5,721,787 A * 2/1998 Neibaur ..... H04R 1/023 381/361
6,149,443 A * 11/2000 Moran ..... H01R 13/2435 439/66
6,953,712 B2 * 10/2005 Usui ..... H01L 21/4846 257/E23.077
7,016,186 B2 * 3/2006 Ueda ..... G06F 1/1616 361/679.23
7,474,537 B2 * 1/2009 Johnson ..... H05K 3/245 361/760
7,561,418 B2 * 7/2009 Na ..... G06F 1/1688 361/679.55
7,999,748 B2 * 8/2011 Ligtenberg ..... H01H 13/705 343/702
8,008,837 B2 * 8/2011 Fukano ..... H03H 9/059 29/25.35
8,036,411 B2 * 10/2011 Daimon ..... H04M 1/03 381/346
8,269,675 B2 * 9/2012 Kough ..... H01Q 1/2266 343/702
8,338,690 B2 * 12/2012 Murozono ..... H01L 31/035281 136/243
8,847,617 B2 * 9/2014 Nickel ..... G01R 31/3025 324/754.21
8,864,039 B2 * 10/2014 Manzi ..... G06K 19/07749 235/492
9,105,967 B2 * 8/2015 Park ..... H01Q 1/243
2004/0198264 A1 * 10/2004 Saur ..... H01Q 1/245 455/117
2007/0139876 A1 6/2007 Na
2012/0095916 A1 * 4/2012 Dorsey ..... G06Q 20/3224 705/44

FOREIGN PATENT DOCUMENTS

| | | |
|---|---|---|
| CN | 102142855 | 8/2011 |
| CN | 102646862 | 8/2012 |
| TW | 201143577 | 12/2011 |
| TW | 201234949 | 8/2012 |

OTHER PUBLICATIONS

"Office Action of China Counterpart Application", dated Nov. 1, 2016, p. 1-p. 7.

* cited by examiner electronic device 100 electronic device 100a

ELECTRONIC DEVICE AND CONDUCTIVE STRUCTURE

CROSS-REFERENCE TO RELATED APPLICATION

This application claims the priority benefits of U.S. provisional application Ser. No. 61/804,183, filed on Mar. 21, 2013. The entirety of the above-mentioned patent application is hereby incorporated by reference herein and made a part of this specification.

BACKGROUND

Field of the Application

The application is directed to a conductive structure and an electronic device and more particularly, to a conductive structure and an electronic device having a sound-output opening.

Description of Related Art

In recent years, with the prosperous developments of the technology industries, electronic devices such as Notebook computers (NB), tablet computers and smart phones are frequently used in our daily life. Types and functions of the electronic devices have become increasingly diverse, and because of convenience and practicality, the electronic devices have become more and more popular and can be used for various purposes.

In order to increase the use of functions, an electronic device is generally installed with a speaker inside for playing music or audio data. In this case, a sound-output opening is disposed on a casing of the electronic device, such that sound output by the internal speaker of the electronic device can be transmitted to the outside of the electronic device. Generally, a casing of an electronic device has at least one conductive contact for transmitting conductive signals if being disposed with an antenna. However, the location on the casing where the sound-output opening is disposed can not be disposed with the conductive contact because the conductive contact will affect sound output effect easily, and therefore, the conductive contact has to be disposed in a way to avoid the location of the sound-output opening, which causes difficulty and limitation to the design.

SUMMARY

Accordingly, the application provides a conductive structure capable of preventing liquid from intruding therein via through holes, so that a function of a conductive elastic pad will not be influenced.

The application provides an electronic device capable of preventing liquid from intruding therein via through holes, so that a function of a conductive elastic pad will not be influenced, and a sound-output function of through holes may be thereby maintained.

The conductive structure of the application includes a conductive casing, a conductive sheet, a conductive elastic pad and a circuit board. The conductive casing has an inner surface and a plurality of through holes extending from the inner surface to the outside of the conductive casing to penetrate through the conductive casing. The conductive sheet is disposed on the inner surface of the conductive casing and covers part of the plurality of through holes from the inner surface. The conductive elastic pad is disposed in the conductive casing and contacts the conductive sheet. The circuit board is disposed in the conductive casing and connected with the conductive elastic pad.

The electronic device of the application includes a conductive casing, a conductive sheet, a conductive elastic pad, a circuit board and a sound output unit. The conductive casing has an inner surface and a plurality of through holes extending from the inner surface to the outside of the conductive casing to penetrate the conductive casing. The conductive sheet is disposed on the inner surface of the conductive casing and covers part of the plurality of through holes from the inner surface. The conductive elastic pad is disposed in the conductive casing and contacts the conductive sheet. The circuit board is disposed in conductive casing and connected with the conductive elastic pad. The sound output unit is disposed in the conductive casing, electrically connected to the circuit board and adapted to output a sound. The sound is transmitted to the outside of the electronic device via another part of the plurality of through holes.

To sum up, in the conductive structure and the electronic device of the application, the conductive sheet covers part of the plurality of through holes penetrating through the casing, and the conductive elastic pad contacts the conductive sheet. By doing so, the conductive structure and the electronic device of the application can utilize the conductive sheet to prevent liquid from intruding into the internal, and thereby the function of the conductive elastic pad will not be influenced. Moreover, the sound output by the sound output unit of the electronic device of the application can be transmitted to the outside of the electronic device via another part of the plurality of through holes. Accordingly, the electronic device of the application can maintain the sound output function via the through holes.

In order to make the aforementioned and other features and advantages of the present application more comprehensible, several embodiments accompanied with figures are described in detail below.

BRIEF DESCRIPTION OF THE DRAWINGS

The accompanying drawings are included to provide a further understanding of the present application, and are incorporated in and constitute a part of this specification. The drawings illustrate embodiments of the present application and, together with the description, serve to explain the principles of the present application.

DESCRIPTION OF EMBODIMENTS

Figure 1:
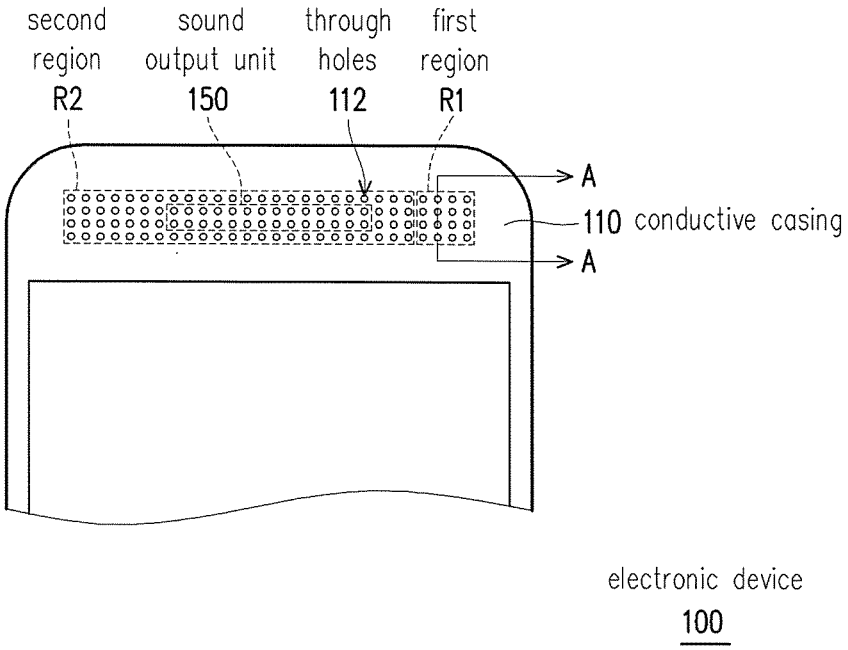
FIG. 1 is a schematic top view illustrating is an electronic device according to an embodiment of the application.
Figure 2:
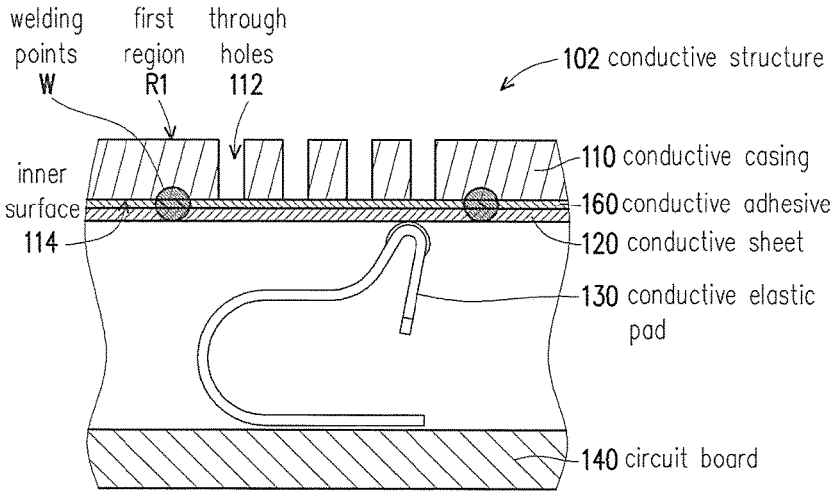
FIG. 2 is a cross-sectional view of the electronic device depicted in FIG. 1 along a line A-A.

FIG. 1 is a schematic top view illustrating is an electronic device according to an embodiment of the application, and FIG. 2 is a cross-sectional view of the electronic device depicted in FIG. 1 along a line A-A. With reference to FIG. 1 through FIG. 2, in the present embodiment, an electronic device 100 includes a conductive casing 110, a conductive sheet 120, a conductive elastic pad 130, a circuit board 140 and a sound output unit 150. The conductive sheet 120, the conductive elastic pad 130, the circuit board 140 and the sound output unit 150 are disposed in the conductive casing 110. The conductive casing 110, the conductive sheet 120, the conductive elastic pad 130 and the circuit board 140 may considered as a conductive structure 102 of the electronic device 100. The conductive casing 110 has a plurality of through holes 112 arranged in an array on the conductive casing 110 of the electronic device 100 and visible from the outside of the electronic device 100, as shown in FIG. 1. In the present embodiment, the electronic device 100 is, for example, a smart phone, while the sound output unit 150 is, for example, a speaker, but the application is not intent to limit the types of the electronic device 100 and the sound output unit 150. The sound output unit 150 is adapted to output a sound. The electronic device 100 may transmit the sound out of the electronic device 100 by using the plurality of through holes 112 as sound-output openings.

To be more specific, in the present embodiment, the conductive casing 110 has an inner surface 114. The plurality of through holes 112 extend from the inner surface 114 to the outside of the conductive casing 110 to penetrate through the conductive casing 110, as shown in FIG. 2. In the present embodiment, the conductive casing 110 is made of a conductive material, but the application is not limited thereto. In other embodiments, only a portion of the conductive casing 110 is conductive, e.g., only a portion of the plurality of through holes 112 adjacent to the inner surface 114 is conductive material. In more detailed, the conductive casing 110 may entirely be made of metal or made by attaching a conductive material to a surface of non-conductive material by way of plating, coating or the like to achieve the same effect. The conductive sheet 120 is disposed on the inner surface 114 of the conductive casing 110, contacts the portion on the inner surface 114 that has conductivity and covers part of the plurality of through holes 112 from the inner surface 114. A material of at least a portion of the conductive sheet 120 is gold, such as a gold-plate pad, wherein the inner material thereof is copper, and the outside surfaces thereof are plating with gold, but the application is not intent to limit the material of the conductive sheet 120. The conductive elastic pad 130 is disposed in the conductive casing 110 and contacts the conductive sheet 120. The conductive elastic pad 130 is generally arc-shaped and contacts the conductive sheet 120 with its arc-shaped surface. The circuit board 140 is disposed in the conductive casing 110 and electrically connected with the conductive elastic pad 130. Thus, the conductive elastic pad 130 is connected with the conductive casing 110 via the conductive sheet 120, such that the conductive casing 110 may be served as an antenna structure of the electronic device 100. In addition, the sound output unit 150 is disposed in the conductive casing 110 and electrically connected to the circuit board 140. The sound output by the sound output unit 150 is transmitted to the outside of the electronic device 100 via another part of the plurality of through holes 112 that are not covered by the conductive sheet 120.

In the present embodiment, the conductive casing 110 of the electronic device 100 has a first region R1 and a second region R2 adjacent to the first region R1, and the plurality of through holes 112 of the conductive casing 110 are arranged in an array in the first region R1 and the second region R2, as shown in FIG. 1. The conductive sheet 120 disposed on the inner surface 114 of the conductive casing 110 substantially corresponds to the first region R1, so that the conductive sheet 120 covers the plurality of through holes 112 located in the first region R1 from the inner surface 114. Herein, the plurality of through holes 112 located in the second region R2 is not covered by the conductive sheet 120, and the sound output by the sound output unit 150 is transmitted to the outside of the electronic device 100 via the plurality of through holes 112 located in the second region R2. Accordingly, the conductive structure 102 and the electronic device 100 may utilize the conductive sheet 120 to prevent liquid from intruding therein via the plurality of through holes 112 located in the first region R1 to affect the function of the conductive elastic pad 130, (for example, contact failure between the conductive elastic pad 130 and the conductive casing 110 or rust occurring on the conductive elastic pad 130), and the sound output by the sound output unit 150 of the electronic device 100 may be transmitted to the outside of the electronic device 100 via the plurality of through holes 112 located in the second region R2 so as to maintain the function of outputting the sound.

With reference to FIG. 2, in the present embodiment, the conductive structure 102 of the electronic device 100 further includes a conductive adhesive 160 disposed between the conductive sheet 120 and the inner surface 114 of the conductive casing 110 and corresponds to the first region R1. Thus, the conductive sheet 120 may be adhered to the inner surface 114 of the conductive casing 110 by using the conductive adhesive 160 to cover the plurality of through holes 112 located in the first region R1. The conductive adhesive 160 of the present embodiment is, for example, a colored conductive adhesive, and a color thereof may be selected according to demand. For example, color that is approximate to that of the conductive casing 110 may be chosen. The conductive adhesive 160 may cover the conductive sheet 120 to avoid a color of the conductive sheet 120 made of gold being more apparent than the conductive casing 110, such that the appearance of the electronic device 100 will not be ruined. Accordingly, when a user sees the plurality of through holes 112 from the outside of the electronic device 100, the color of the conductive adhesive 160 may facilitate in maintaining color appearance of the plurality of through holes 112 and the conductive casing 110 in consistency. However, the application is not limit the conductive adhesive 160 to having a color, and the conductive adhesive may also be transparent.

Moreover, in the present embodiment, the conductive sheet 120 is further connected to the conductive casing 110 via a plurality of welding points W. The conductive sheet 120 may be fastened to the conductive casing 110 by laser welding the welding points W formed thereon. The welding points W are located at places on the inner surface 114 rather than the first region R1 where the plurality of through holes 112 are disposed, such that the plurality of through holes 112 will not be influenced. The disposition of the welding points W not only strengthens the connection force between the conductive sheet 120 and the conductive casing 110 but also prevent the conductive sheet 120 from being rusted by the liquid.

Figure 3:
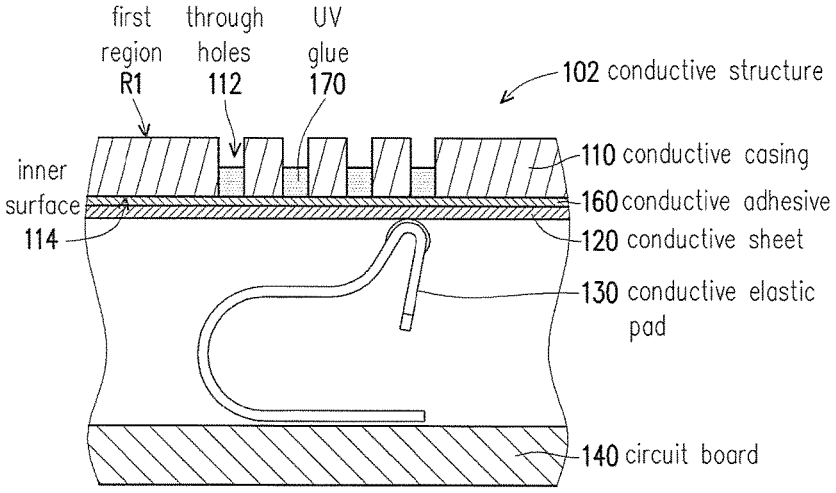
FIG. 3 is a cross-sectional view of an electronic device according to another embodiment of the application.
Figure 4A:
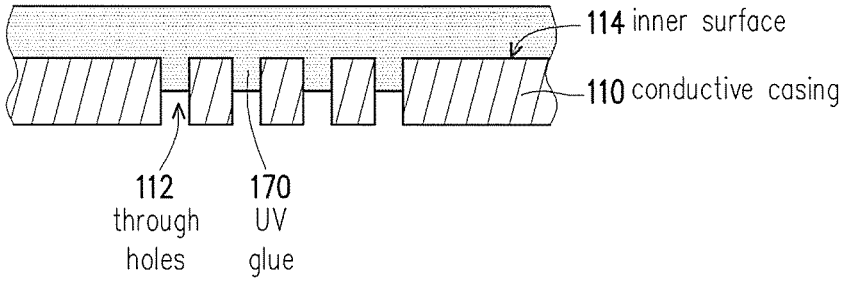
FIG. 4A through FIG. 4B schematically illustrate a process of fabricating the conductive structure depicted in FIG. 3.
Figure 4B:
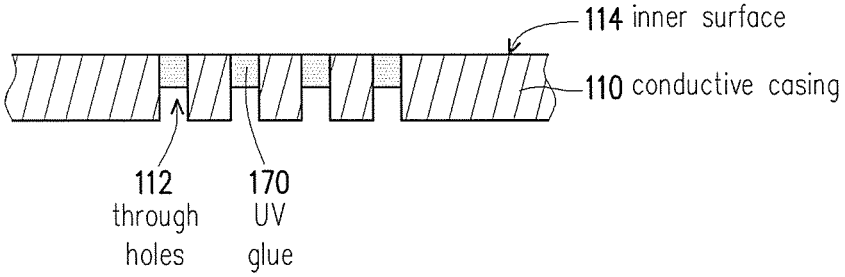

FIG. 3 is a cross-sectional view of an electronic device according to another embodiment of the application. FIG. 4A through FIG. 4B schematically illustrate a process of fabricating the conductive structure depicted in FIG. 3. With reference to FIG. 3, FIG. 4A and FIG. 4B, in the present embodiment, a electronic device 100*a* has a structure and a function similar to the electronic device 100 of the aforementioned embodiments and is mainly different from the electronic device 100 in that the electronic device 100*a* has a conductive structure 102*a* that does not utilize the welding points W to fasten the conductive sheet 120 or prevent the conductive sheet 120 from being rusted by the liquid. The other elements of the electronic device 100*a* that are labeled by the same numerals as those of the electronic device 100 have the same structures and functions will not be repeatedly described hereinafter. Only the difference between the electronic device 100*a* and the electronic device 100 will be described.

With reference to FIG. 3, in the present embodiment, the conductive structure 102*a* of the electronic device 100*a* further includes an ultraviolet glue (UV glue) 170 disposed in the plurality of through holes 112 located in the first region R1 and used to seal the plurality of through holes 112 located in the first region R1. Moreover, the UV glue 170 seals one end of each of the plurality of through holes 112 located in the first region R1 adjacent to the inner surface 114. A method of filling the UV glue 170 in the plurality of through holes 112 located in the first region R1 is illustrated in FIG. 4A through FIG. 4B. First, the conductive casing 110 having the plurality of through holes 112 is placed upside down, and the UV glue 170 is poured into an internal place of the conductive casing 110 that corresponds to the first region R1, such that UV glue 170 naturally flows vertical into one end of each of the plurality of through holes 112 adjacent to the inner surface 114. Then, until the UV glue 170 flows into the plurality of through holes 112 for a predetermined depth, the UV glue 170 is radiated and solidified by the UV ray, such that the UV glue 170 is fastened in the plurality of through holes 112. Finally, the UV glue 170 protruding from the plurality of through holes 112 on the conductive casing 110 is removed by a machining process (e.g., a computer numerical control (CNC) process), such that the UV glue 170 is merely located inside the plurality of through holes 112, and the impact on the electrical connection between the conductive sheet 120 and the conductive casing 110 is prevented. Likewise, in the present embodiment, the conductive sheet 120 is adhered to the inner surface 114 of the conductive casing 110 by using the conductive adhesive 160. At this moment, the plurality of through holes 112 located in the first region R1 is sealed by the UV glue 170, and an issue of liquid intruding into the conductive casing 110 by way of the plurality of through holes 112 can be prevented. Thereby, the conductive sheet 120 can be prevented from being rusted by liquid and moisture.

Based on the above, in the conductive structure and the electronic device of the application, the conductive sheet covers part of the plurality of through holes penetrating through the conductive casing, and the conductive elastic pad contacts the conductive sheet. By doing so, the conductive structure and the electronic device of the application can utilize the conductive sheet to prevent liquid from intruding into the internal, and thereby the function of the conductive elastic pad will not be influenced. Moreover, the conductive structure and the electronic device of the application can also prevent the conductive sheet used for covering the plurality of through holes from being rusted by the liquid by disposing the welding points on the conductive sheet or filling the UV glue in the plurality of through holes. In addition, the sound output by the sound output unit of the electronic device of the application can be transmitted to the outside by another part of plurality of through holes that are not covered by the conductive sheet. Accordingly, the electronic device of the application can maintain the sound-output function with the plurality of through holes.

Although the application has been described with reference to the above embodiments, it will be apparent to one of the ordinary skill in the art that modifications to the described embodiment may be made without departing from the spirit of the application. Accordingly, the scope of the application will be defined by the attached claims not by the above detailed descriptions.

What is claimed is:

1. A conductive structure, disposed in a portable electronic device, comprising:

a conductive casing, having an inner surface and a plurality of through holes extending from the inner surface to the outside of the conductive casing to penetrate through the conductive casing;

a conductive sheet, disposed on the inner surface of the conductive casing and covering part of the plurality of through holes from the inner surface;

a conductive elastic pad, disposed in the conductive casing and contacting the conductive sheet, wherein the conductive elastic pad is connected with the conductive casing via the conductive sheet, and the conductive casing is served as an antenna structure; and a circuit board, disposed in the conductive casing and electrically connected with the conductive elastic pad, wherein the conductive casing has a first region and a second region adjacent to the first region, the plurality of through holes is arranged in an array in the first region and the second region, the conductive sheet corresponds to the first region and covers the plurality of through holes located in the first region, and the conductive elastic pad corresponds to the first region.

2. The conductive structure according to claim 1, further comprising:

a conductive adhesive, disposed between the conductive sheet and the inner surface of the conductive casing and corresponding to the first region.

3. The conductive structure according to claim 2, wherein the conductive adhesive is a colored conductive adhesive.

4. The conductive structure according to claim 1, further comprising:

an ultraviolet glue (UV glue), disposed in the plurality of through holes located in the first region to seal the plurality of through holes located in the first region.

5. The conductive structure according to claim 4, wherein the UV glue seals one end of each of the plurality of through holes located in the first region adjacent to the inner surface.

6. The conductive structure according to claim 1, wherein the conductive sheet is connected to the conductive casing via a plurality of welding points.

7. The conductive structure according to claim 1, wherein a material of at least a portion of the conductive sheet is gold.

8. The conductive structure according to claim 1, wherein at least a portion of the conductive casing is conductive, and the conductive sheet contacts the portion.

9. A portable electronic device, comprising:

a conductive casing, having an inner surface and a plurality of through holes extending from the inner surface to the outside of the conductive casing to penetrate through the conductive casing;

a conductive sheet, disposed on the inner surface of the conductive casing and covering part of the plurality of through holes from the inner surface;

a conductive elastic pad, disposed in the conductive casing and contacting the conductive sheet, wherein the conductive elastic pad is connected with the conductive casing via the conductive sheet, and the conductive casing is served as an antenna structure;

a circuit board, disposed in the conductive casing and connected with the conductive elastic pad; and a sound output unit, disposed in the conductive casing and electrically connected to the circuit board and adapted to output a sound transmitted to the outside of the electronic device via another part of the plurality of through holes, wherein the conductive casing has a first region and a second region adjacent to the first region, the plurality of through holes is arranged in an array in the first region and the second region, the conductive sheet corresponds to the first region and covers the plurality of through holes located in the first region, and the conductive elastic pad corresponds to the first region.

10. The electronic device according to claim 9, wherein the sound output by the sound output unit is transmitted to the outside of the electronic device via the plurality of through holes located in the second region.

11. The electronic device according to claim 9, further comprising:

a conductive adhesive, disposed between the conductive sheet and the inner surface of the conductive casing and corresponding to the first region.

12. The electronic device according to claim 11, wherein the conductive adhesive is a colored conductive adhesive.

13. The electronic device according to claim 9, further comprising:

an UV glue, disposed in the plurality of through holes located in the first region to seal the plurality of through holes located in the first region.

14. The electronic device according to claim 13, wherein the UV glue seals one end of each of the plurality of through holes located in the first region adjacent to the inner surface.

15. The electronic device according to claim 9, wherein the conductive sheet is connected to the conductive casing via a plurality of welding points.

16. The electronic device according to claim 9, wherein a material of at least a portion of the conductive sheet is gold.

17. The electronic device according to claim 9, wherein at least a portion of the conductive casing is conductive, and the conductive sheet contacts the portion.

18. The electronic device according to claim 9, wherein the sound output is a speaker.

* * * * *